US010900313B2

(12) United States Patent
McAdam et al.

(10) Patent No.: US 10,900,313 B2
(45) Date of Patent: Jan. 26, 2021

(54) METHOD AND APPARATUS FOR PRODUCTION WELL PRESSURE CONTAINMENT FOR BLOWOUT

(71) Applicant: Dreco Energy Services ULC, Edmonton (CA)

(72) Inventors: David McAdam, Calgary (CA); Brian McAdam, Calgary (CA); James Orr, Sherwood Park (CA)

(73) Assignee: DRECO ENERGY SERVICES ULC, Calgary (CA)

( * ) Notice: Subject to any disclaimer, the term of this patent is extended or adjusted under 35 U.S.C. 154(b) by 0 days.

(21) Appl. No.: 16/316,661

(22) PCT Filed: Jul. 25, 2017

(86) PCT No.: PCT/CA2017/050890
§ 371 (c)(1),
(2) Date: Jan. 10, 2019

(87) PCT Pub. No.: WO2018/018142
PCT Pub. Date: Feb. 1, 2018

(65) Prior Publication Data

US 2019/0234167 A1 Aug. 1, 2019

Related U.S. Application Data

(60) Provisional application No. 62/366,834, filed on Jul. 26, 2016.

(51) Int. Cl.
*E21B 33/03* (2006.01)
*E21B 33/02* (2006.01)
(Continued)

(52) U.S. Cl.
CPC ..... *E21B 33/03* (2013.01); *E21B 33/02* (2013.01); *E21B 41/0021* (2013.01); *E21B 33/06* (2013.01); *E21B 43/126* (2013.01)

(58) Field of Classification Search
CPC ..... E21B 33/03; E21B 33/02; E21B 33/038; E21B 43/26; E21B 41/0021; E21B 33/06; E21B 43/126
See application file for complete search history.

(56) References Cited

U.S. PATENT DOCUMENTS 665,073 A 1/1901 Doyle et al.
958,862 A 5/1910 Durham
(Continued)

FOREIGN PATENT DOCUMENTS

CA 2153612 A1 1/1997
CA 2544718 A1 11/2006
(Continued)

OTHER PUBLICATIONS

"International Application Serial No. PCT CA2017 050890, International Preliminary Report on Patentability dated Feb. 7, 2019", 7 pgs.

(Continued)

*Primary Examiner* — Michael R Wills, III
(74) *Attorney, Agent, or Firm* — Schwegman Lundberg & Woessner, P.A.

(57) ABSTRACT

Apparatus and methodologies are provided for modifying the wellhead structure of a production well to seal the production well before subterranean fracturing operations. The apparatus includes an enclosure tubular and adapter 5 for sealingly engaging the polish rod extending from the wellhead structure, while maintaining the entire rod string in tension in a manner to ensure that the string and its connection with the downhole pump are not compromised. More specifically, the present preparations involve retaining the rod string in tension while removing at least the stuffing box from the wellhead structure, and 10 temporarily install-
(Continued)

ing the enclosure tubular and adapter to seal the wellhead, preventing wellbore blowouts.

20 Claims, 8 Drawing Sheets

(51) Int. Cl.

| | |
|---|---|
| ***E21B 41/00*** | (2006.01) |
| *E21B 33/06* | (2006.01) |
| *E21B 43/12* | (2006.01) |

(56) References Cited

U.S. PATENT DOCUMENTS

| | | | | |
|---|---|---|---|---|
| 1,517,504 | A | 12/1924 | Hansen | |
| 1,517,540 | A | 12/1924 | Ira | |
| 1,891,417 | A | 12/1932 | Heggem | |
| 2,059,798 | A | 11/1936 | Kniss | |
| 2,237,709 | A | 4/1941 | Lowe | |
| 2,258,887 | A | 10/1941 | Fortune | |
| 2,573,832 | A | 11/1951 | Harold | |
| 2,846,013 | A | 8/1958 | Davis | |
| 3,084,946 | A | 4/1963 | Sharp | |
| 3,149,514 | A | 9/1964 | Shaub | |
| 3,186,722 | A | 6/1965 | Johnston | |
| 3,195,645 | A | 7/1965 | Doyle | |
| 3,651,717 | A | 3/1972 | Johnston | |
| 3,716,245 | A | 2/1973 | Turolla | |
| 3,796,103 | A * | 3/1974 | Winfield, Jr. | F16J 3/048 74/18.2 |
| 3,830,304 | A * | 8/1974 | Cummins | E21B 33/068 166/305.1 |
| 4,071,085 | A | 1/1978 | Grable et al. | |
| 4,153,111 | A * | 5/1979 | Lans | E21B 33/03 166/377 |
| 4,407,510 | A | 10/1983 | Cornelius et al. | |
| 4,560,176 | A | 12/1985 | Hoff | |
| 4,580,762 | A | 4/1986 | Hirtz et al. | |
| 4,583,569 | A | 4/1986 | Ahlstone | |
| 4,613,140 | A | 9/1986 | Knox | |
| 4,716,970 | A * | 1/1988 | Henning | E21B 29/00 166/298 |
| 4,777,849 | A | 10/1988 | Sears | |
| 4,865,245 | A | 9/1989 | Schulte et al. | |
| 4,869,184 | A | 12/1989 | Lugtmeier et al. | |
| 4,951,743 | A | 8/1990 | Henderson | |
| 5,257,812 | A | 11/1993 | Osorio et al. | |
| 5,400,857 | A | 3/1995 | Whitby et al. | |
| 5,408,901 | A | 4/1995 | Bishop | |
| 5,636,688 | A | 6/1997 | Bassinger | |
| 5,641,019 | A | 6/1997 | Stout et al. | |
| 5,711,533 | A | 1/1998 | Angelo et al. | |
| 5,791,411 | A | 8/1998 | Ricalton et al. | |
| 5,865,245 | A | 2/1999 | Trout et al. | |
| 6,176,466 | B1 | 1/2001 | Lam et al. | |
| 7,216,872 | B1 | 5/2007 | Shaw et al. | |
| 8,544,535 | B2 | 10/2013 | Cote et al. | |
| 8,631,861 | B1 | 1/2014 | Busch | |
| 8,746,345 | B2 | 6/2014 | Kotrla et al. | |
| 8,899,338 | B2 | 12/2014 | Elsayed et al. | |
| 9,188,122 | B1 | 11/2015 | Reed | |
| 9,702,203 | B2 | 7/2017 | Bolstad, Jr. | |
| 10,597,968 | B2 | 3/2020 | McAdam et al. | |
| 2003/0070806 | A1 | 4/2003 | Connell et al. | |
| 2003/0221844 | A1* | 12/2003 | Dallas | E21B 33/072 166/381 |
| 2006/0081368 | A1 | 4/2006 | Rosine et al. | |
| 2006/0124314 | A1 | 6/2006 | Haheim et al. | |
| 2008/0078558 | A1* | 4/2008 | Dallas | E21B 33/068 166/381 |
| 2009/0058930 | A1 | 3/2009 | Angelle et al. | |
| 2009/0260834 | A1 | 10/2009 | Henson et al. | |
| 2011/0168405 | A1 | 7/2011 | Parlee | |
| 2011/0198072 | A1 | 8/2011 | Cote et al. | |
| 2011/0203870 | A1 | 8/2011 | Braddick | |
| 2011/0266005 | A1 | 11/2011 | Hult et al. | |
| 2011/0278515 | A1 | 11/2011 | Perio | |
| 2012/0012339 | A1 | 1/2012 | Weir et al. | |
| 2012/0012340 | A1 | 1/2012 | Ensley et al. | |
| 2012/0024521 | A1* | 2/2012 | Villa | E21B 23/08 166/75.11 |
| 2012/0305102 | A1 | 12/2012 | Kukielka | |
| 2013/0126157 | A1 | 5/2013 | Farrar | |
| 2013/0126763 | A1 | 5/2013 | Guo et al. | |
| 2013/0147121 | A1 | 5/2013 | Xu | |
| 2013/0180733 | A1 | 7/2013 | Bradshaw et al. | |
| 2013/0199773 | A1 | 8/2013 | Tebay | |
| 2013/0327528 | A1 | 12/2013 | Frost | |
| 2013/0341045 | A1 | 12/2013 | Flusche | |
| 2015/0047558 | A1 | 2/2015 | Varkey et al. | |
| 2015/0215903 | A1 | 7/2015 | Sellers, Jr., et al. | |
| 2015/0285013 | A1 | 10/2015 | Johnson et al. | |
| 2015/0300106 | A1 | 10/2015 | Martin et al. | |
| 2016/0251917 | A1 | 9/2016 | Harrell et al. | |
| 2017/0146007 | A1 | 5/2017 | Robison et al. | |
| 2017/0306745 | A1 | 10/2017 | Harding et al. | |
| 2018/0202254 | A1 | 7/2018 | Mcadam et al. | |
| 2019/0040696 | A1 | 2/2019 | Mcadam et al. | |
| 2019/0049017 | A1 | 2/2019 | Mcadam et al. | |
| 2019/0093411 | A1 | 3/2019 | Mcadam et al. | |
| 2019/0360299 | A1 | 11/2019 | Mcadam et al. | |

FOREIGN PATENT DOCUMENTS

| | | | |
|---|---|---|---|
| CA | 2509182 | A1 | 12/2006 |
| CA | 2942857 | A1 | 10/2015 |
| CA | 2991538 | A1 | 1/2017 |
| CA | 3013084 | A1 | 8/2017 |
| CN | 2567336 | | 8/2003 |
| CN | 202090881 | U | 12/2011 |
| CN | 202731817 | | 2/2013 |
| GB | 2206932 | A | 1/1989 |
| WO | WO-2017004696 | A1 | 1/2017 |
| WO | 2018018142 | | 2/2018 |
| WO | WO-2018049503 | A1 | 3/2018 |
| WO | WO-2018129620 | A1 | 7/2018 |
| WO | WO-2018213918 | A1 | 11/2018 |
| WO | WO-2019056088 | A1 | 3/2019 |

OTHER PUBLICATIONS

"International Application Serial No. PCT CA2017 050890, International Search Report dated Oct. 17, 2017", 3 pgs.
"International Application Serial No. PCT CA2017 050890, Written Opinion dated Oct. 17, 2017", 4 pgs.
"U.S. Appl. No. 15/742,632, Corrected Notice of Allowability dated Jan. 21, 2020", 2 pgs.
"U.S. Appl. No. 15/742,632, Non Final Office Action dated Jun. 26, 2019", 13 pgs.
"U.S. Appl. No. 15/742,632, Notice of Allowanced dated Nov. 14, 2019", 5 pgs.
"U.S. Appl. No. 15/742,632, Preliminary Amendment filed Jan. 8, 2018", 3 pgs.
"U.S. Appl. No. 15/742,632, Response filed Oct. 28,2 019 to Non-Final Office Action dated Jun. 26, 2019", 9 pgs.
"U.S. Appl. No. 15/989,877, Examiner Interview Summary dated Aug. 18, 2020", 3 pgs.
"U.S. Appl. No. 15/989,877, Final Office Action dated Jun. 1, 2020", 18 pgs.
"U.S. Appl. No. 15/989,877, Non Final Office Action dated Dec. 6, 2019", 17 pgs.
"U.S. Appl. No. 15/989,877, Response filed Mar. 6, 2020 to Non Final Office Action dated Dec. 6, 2019", 9 pgs.
"U.S. Appl. No. 16/076,574, Examiner Interview Summary dated Jun. 12, 2020", 3 pgs.
"U.S. Appl. No. 16/076,574, Non Final Office Action dated Apr. 2, 2020", 7 pgs.
"U.S. Appl. No. 16/076,574, Response filed Jul. 2, 2020 to Non Final Office Action dated Apr. 2, 2020", 10 pgs.

(56) References Cited

OTHER PUBLICATIONS

"U.S. Appl. No. 16/139,690, Non Final Office Action dated May 13, 2020", 13 pgs.
"U.S. Appl. No. 16/139,690, Response filed Aug. 10, 2020 to Non-Final Office Action dated May 13, 2020", 11 pgs.
"U.S. Appl. No. 16/478,061, Non Final Office Action dated Aug. 5, 2020", 15 pgs.
"U.S. Appl. No. 16/478,061, Preliminary Amendment filed Jul. 15, 2019", 8 pgs.
"International Application Serial No. PCT/CA2016/050373, International Preliminary Report on Patentability dated Jan. 18, 2018", 6 pgs.
"International Application Serial No. PCT/CA2015/050373, International Search Report dated May 30, 2016", 3 pgs.
"International Application Serial No. PCT/CA2016/050373, Written Opinion dated May 30, 2016", 4 pgs.
"International Application Serial No. PCT/CA2016/051532, International Preliminary Report on Patentability dated Mar. 28, 2019", 7 pgs.
"International Application Serial No. PCT/CA2016/051532, International Search Report dated Jan. 23, 2017", 3 pgs.
"International Application Serial No. PCT/CA2015/051532, Written Opinion dated Jan. 23, 2017", 4 pgs.
"International Application Serial No. PCT/CA2017/050161, International Preliminary Report on Patentability dated Aug. 14, 2018", 5 pgs.
"International Application Serial No. PCT/CA2017/050161, Interantional Search Report dated Apr. 24, 2017", 3 pgs.
"International Application Serial No. PCT/CA2017/050161, Written Opinion dated Apr. 24, 2017", 4 pgs.
"International Application Serial No. PCT/CA2017/050963, International Search Report dated Nov. 8, 2017", 3 pgs.
"International Application Serial No. PCT/CA2017/050963, Written Opinion dated Nov. 8, 2017", 5 pgs.
"International Application Serial No. PCT/CA2018/000101, International Preliminary Report on Patentability dated Dec. 5, 2019", 6 pgs.
"International Application Serial No. PCT/CA2018/00101, International Search Report dated Oct. 26, 2018", 4 pgs.
"International Application Serial No. PCT/CA2018/000101, Written Opinion dated Oct. 26, 2018", 4 pgs.
"International Application Serial No. PCT/CA2018/000179, International Preliminary Report on Patentability dated Dec. 12, 2019", 8 pgs.
"International Application Serial No. PCT/CA2018/000179, International Search Report dated Dec. 21, 2018", 3 pgs.
"International Application Serial No. PCT/CA2018/000179, Response filed Jul. 25, 2019 to Written Opinion dated Dec. 21, 2018", 5 pgs.
"International Application Serial No. PCT/CA2018/000179, Written Opinion dated Dec. 21, 2018", 4 pgs.
"International Application Serial No. PCT/CA2018/050025, International Preliminary Report on Patentability dated Jul. 25, 2019", 6 pgs.
"International Application Serial No. PCT/CA2018/050025, International Search Report dated Apr. 4, 2018", 3 pgs.
"International Application Serial No. PCT/CA2018/050025, Written Opinion dated Apr. 4, 2018", 4 pgs.
"KH2030 20mm Ball Bushing 20×28×30 Linear Motion Bearing", VXB.com Bearings, [Online]. Retrieved from the InternetL <URL: http://www.vxb.com/KH2030-20mm-Ball-Bushing-20×28×30-Linear-Motion-p/Kit7140.htm?gclid= EAlalQobChMlsda3qpOc2wIVAtvACh1MlwBVEAYYBSABEgK7HvD_BwE, (Accessed May 14, 2020), 7 pgs.
"Pro Align (Opal)", Bell Industries A Division of Bell Envirotech Inc., [Online], Retrieved from the Internet: –URL: http://www.bellindustries.ca/index.php/gallery1/harbison-fiseher/pro-align>, (2020), 2 pgs.
"Pro Align (Opal)"Harbison-Fischer Well Head Tools, (2020), 1 pg.
"Rod String", Dynatec International Ltd., [Online]. Retrieved from the Internet: <URL: https://protect-us.mimecast.com/s/0F_HC9rOL0HkW2oNHODTVr?domain=nelgarservices.com>, (2012), 1 pg.
"Rod-Knuckle Enviromental Bob Stuffing Box", Nelgar Services Inc., [Online]. Retrieved from the Internet: –URL: https://protect-us.minecast.com/s/0F_HC9rOL0HkW2oNHODTVr?domain=nelgarservices.com>, (2017), 4 pgs.
"Rod-Pump Accesories", Apergy Artificial Lift Technologies, [Online]. Retrieved from the Internet: <URL: https://apergyals.com/products/rod-lift/harbison-fischer/rod-pump-accessories/>, (2020), 11 pgs.
"The Weekly Screw", The Virtual Corkscrew Museum's Weekly Newspaper Number 469, [Online]. [Accessed Nov. 8, 2018]. >Retrieved from the Internet: <URL: http://www.bullworks.net/daily/20070722.htm>. (Jul. 22, 2007). 14 pgs.
"Wellhead Accessories", Apergy Artificial Lift Technologies, [Online]. Retrieved from the Internet: <URL: https://apergyals.com/products/rod-lift/harbison-fischer/wellhead-accessorites>, (2020), 7 pgs.
"U.S. Appl. No. 15/989,877, Response filed Sep. 1, 2020 to Final Office Action dated Jun. 1, 2020".

* cited by examiner

METHOD AND APPARATUS FOR PRODUCTION WELL PRESSURE CONTAINMENT FOR BLOWOUT

CROSS REFERENCES

This Application claims priority to United States Provisional Patent Application No. 62/366,834, entitled "Method and Apparatus for Production Well Pressure Containment for Blowout Protection", filed Jul. 26, 2016, which is hereby incorporated by reference in its entirety.

TECHNICAL FIELD

Apparatus and methodologies are provided for modifying the wellhead structure of a production well to seal the production well before subterranean fracturing operations are initiated. Herein, an enclosure tubular and adapter are configured for sealingly engaging the wellhead structure, while maintaining the rod string in tension, without compromising the rod string or the arrangement between the rod string and the downhole pump. The present apparatus and methodologies may be used to temporarily replace weaker wellhead componentry to more effectively prevent wellbore blowouts.

BACKGROUND

One or more wells are completed in a subterranean reservoir for the commercial recovery of hydrocarbons therefrom. For economy of the drilling and completion processes, and being cognizant of minimizing surface impact, multiple wells are often drilled adjacent one another. One production well is often adjacent another neighboring well, sometimes in a group from a pad, all of which are often accessing adjacent portions of the same subterranean reservoir. In low pressure or depleted reservoirs, the pressure is low enough that artificial lift is utilized, including the need for downhole pumps. The ubiquitous pump jack is often used to reciprocate a piston in a cylindrical barrel of such a downhole pump. The piston is supported and stroked at the end of the long rod string extending down the well to the pump barrel.

If recovery from an underperforming well is diminishing below commercial thresholds, hydrocarbon recovery enhancement techniques can be applied for stimulating increased production therefrom. One enhancement technique commonly used recently is hydraulic fracturing which utilizes injected high pressure fluids to affect/fracture the structure of the formation, increasing its permeability or fluid conductivity for subsequent and increased flow of hydrocarbons therefrom. Formations are rarely uniform and channels may exist or be formed having high flow paths through otherwise homogeneous structure. Some of these high flow paths can detrimentally traverse between adjacent wells. As a result, high pressure fluids of the fracturing can more-or-less directly access another well and quickly overwhelm the normal production pressure regime and safety equipment of this adjacent production well. However, in part due to the uncertainty of the timing or actual implementation of a fracking operation, an operator of a neighboring production well may be reluctant to engage in an expensive and prospective shutdown of their well. Current methods of sealing the well require that the rod string and downhole pump be removed (involving breaking up the rod, inspecting the integrity thereof, and then reassembling the rod when production resumes). Costs of sealing the well can often exceed tens of thousands of dollars.

As represented in FIG. 1 (PRIOR ART), existing equipment at the neighboring and conventional production wells typically include a downhole pump, a rod string consisting of sucker rod and a polish rod connected to the sucker rod for reaching and driving the downhole pump. The polish rod extends uphole through production wellhead at surface including through one or more blowout preventers (BOP(s)), e.g. rod-type BOP(s), and sealably through a stuffing box to seal the subterranean wellbore from the surface environment. The rod string, at surface, utilizes a dimensionally-controlled polish rod to provide a uniform, sliding sealable surface through the stuffing box.

Unfortunately, while designed for the pressures and operational limitations for production, neither the BOP, nor the stuffing box are generally suitable as a reliable pressure boundaries as against the overwhelming pressures of hydraulic fracturing. Notwithstanding that pressure regimes can be an order of magnitude difference between the low production well and those of the high fracturing pressures, some operators are reluctant to perform advance preparation of adjacent wellheads and instead have relied on the rod BOPs as a safety barrier. However, Isolation valves and full bore BOPs are not operable, even if installed, due to inability to close and seal with a rod string in place. For example, as would be understood, when actuated, rod BOPs form a seal between BOP rams and the polish rod. Failure of the BOP to resist either the excessive pressure results in pressure appearing at the stuffing box above. The stuffing box is the last boundary between the well and the environment. Unfortunately, the conventional stuffing boxes are even less capable of holding against such high pressures than are BOPs and further can result in rod ejection and blowout. Failure of the BOP, stuffing box and rod containment results in significant safety risk, surface contamination and associated recovery, cleanup and cost. Optional actuating of shear rams to cut the rod string and enable use of an isolating valve or BOP in emergency situations are clearly undesirable, dropping of the rod string, and result in a large economic penalty.

Accordingly, there has been an attempt to provide more reasoned and substantive protection at the wellhead in the event of a fracturing pressure breakthrough. Such other means to prepare a production well for adjacent frac operations include purposefully lowering the rod string in a soft set to bottom; or secondly to pull the entirely of the production pump and rod string from the well, in both instances resulting in an unimpeded wellhead bore, for fitting a valve and full bore BOP thereto. The stuffing box is removed in these scenarios. The cost of either these temporary rod removal operations is high. In the second scenario, the operations costly in both removal and re-installation.

In the lowering scenario, the pump is set down at bottom hole, and the rods are lowered into compression, both of which risk damage to the pump or rods. Further, to resume production after the fracturing is complete and pressure returns to normal, the rod string needs to be fished and reconnected to a polish rod as necessary for sealing at a stuffing box. The surface equipment and personnel to recover a lowered pump and rod string, or to initially pull and subsequently run in an entire pump string is significant.

Accordingly, there is a need to temporarily block or seal one or more production wellheads of wells positioned adjacent to subterranean fracturing operations, such that sealed wellheads are able to withstand such inadvertent pressure increases in a safe manner, avoiding catastrophic blowout and rod ejection and, at the least, cost.

SUMMARY

A method of temporarily modifying a production wellhead assembly on a wellbore is provided, wherein the wellhead assembly is or may be subjected to increased wellbore pressures from subterranean fracturing. The wellhead assembly may comprise various componentry for sealing the surface of the wellbore including, at least, one blowout preventer and at least one stuffing box, the componentry forming a central bore for receiving a rod string operatively connected to a drive mechanism for operating a downhole pump. The method may comprise initially positioning the rod string, comprising at least one polish rod, at bottom dead centre, and measuring an enclosure height of an exposed portion of the polish rod, said exposed portion extending upwardly from the wellhead assembly when the rod string is positioned at bottom dead centre. The method may further comprise positioning at least one enclosure tubular over the exposed portion of the polished rod, the enclosure tubular having an upper end and a lower end and having a length substantially equal to the enclosure height, wherein, when in position, the enclosure tubular sealingly engages with the wellhead assembly, and then positioning at least one adapter over the exposed portion of the polish rod, the adapter having an upper end and a lower end, wherein, when in position, the lower end of the adapter sealingly engages with the upper end of the enclosure tubular to receive and contain increased pressures from the fracturing operations.

In some embodiments, the present method may comprise initially sealingly engaging the at least one blowout prevent around the rod string. The method may further comprise removing at least a portion of the at least one stuffing box from the wellhead assembly prior to positioning the enclosure tubular over the exposed portion of the polish rod. Accordingly, the lower end of the enclosure tubular may sealingly engage with at least a lower portion of the stuffing box, or with the blowout preventer of the wellhead assembly. The method may further comprise temporarily positioning at least one rod clamp around the polish rod, securing the polish rod in place on the wellhead assembly.

In some embodiments, measurement of the enclosure height may comprise measuring the height of the exposed portion of the polish rod extending upwardly from the at least one blowout preventer of the wellhead assembly (said enclosure height including or not including a working offset) .

In some embodiments, the method may further comprise coupling the adapter, via the upper end of the adapter, to a lifting device for supporting the weight of the rod sting, maintaining the rod string in tension. In other embodiments, the upper end of the adapter may first be coupled to one or more pony rod tubulars prior to coupling with the lifting device.

According to embodiments herein, the present modifications to the wellhead assembly may be performed prior to the initiation of the fracturing operations. The present preparations may be made to one or more wellhead assemblies adjacent to the wellbore experiencing the subterranean fracturing operations. It should be understood that the present modifications may be quickly and simply performed in reverse in order to return the wellhead assembly to flow operations.

An apparatus for reversibly modifying a production wellhead assembly on a wellbore subjected to increased pressures from subterranean fracturing operations adjacent the wellhead assembly, the wellhead assembly forming a central bore for receiving a rod string operatively connected to a drive mechanism for operating a downhole pump, the apparatus comprising at least one enclosure tubular, the tubular comprising a cylindrical body having upper and lower ends, and a tubular bore in fluid communication with the central bore of the wellhead assembly, for receiving the rod string and providing a fluid pathway therearound, the lower end of the enclosure tubular configured to sealingly connect with the wellhead assembly, the upper end of the enclosure tubular configured to provide a sealing bore, and at least one adapter, the adapter comprising upper and lower ends, the lower end configured for sealingly connecting with the sealing bore of the enclosure tubular to receive and contain the increased pressures from the fracturing operations.

In some embodiments, the wellhead assembly may comprise at least one blowout preventer. The lower end of the enclosure tubular may be configured to sealingly engage with the blowout preventer. In other embodiments, the wellhead assembly may comprise at least one blowout preventer and at least a portion of a stuffing box. The lower end of the enclosure tubular may be configured to sealingly engage with the portion of the stuffing box. Preferably, the lower end of the enclosure tubular may be configured to be slidingly received with a lower portion of the stuffing box.

DESCRIPTION OF EMBODIMENTS

Apparatus and methodologies for modifying the wellhead structure of a production well are provided, the modifications being performed to create a pressure boundary (i.e. seal) at surface of the wellbore during fracturing operations occurring at neighbouring wellbores. The present systems may be used to quickly form pressure boundaries and to temporarily block off one or more wellbore(s) adjacent to fracturing operations before the fracturing operations are initiated, effectively retaining inadvertent overpressures at the modified wellheads caused by the operations adjacent thereto. The present systems may be used to prevent wellbore blowouts and to eliminate risk of rod string ejection from one or more wellbore(s) adjacent to the fracturing operations. Advantageously, the present systems can be used while the rod string remains in tension, without compromising the rod string or its arrangement with the downhole pump. Such a configuration enables the rapid resumption of production after the neighbouring fracturing operations are completed. Moreover, in circumstances where the neighbouring fracturing operation is cancelled, the time and costs to prepare and resume normal production is minimized.

Figure 1:
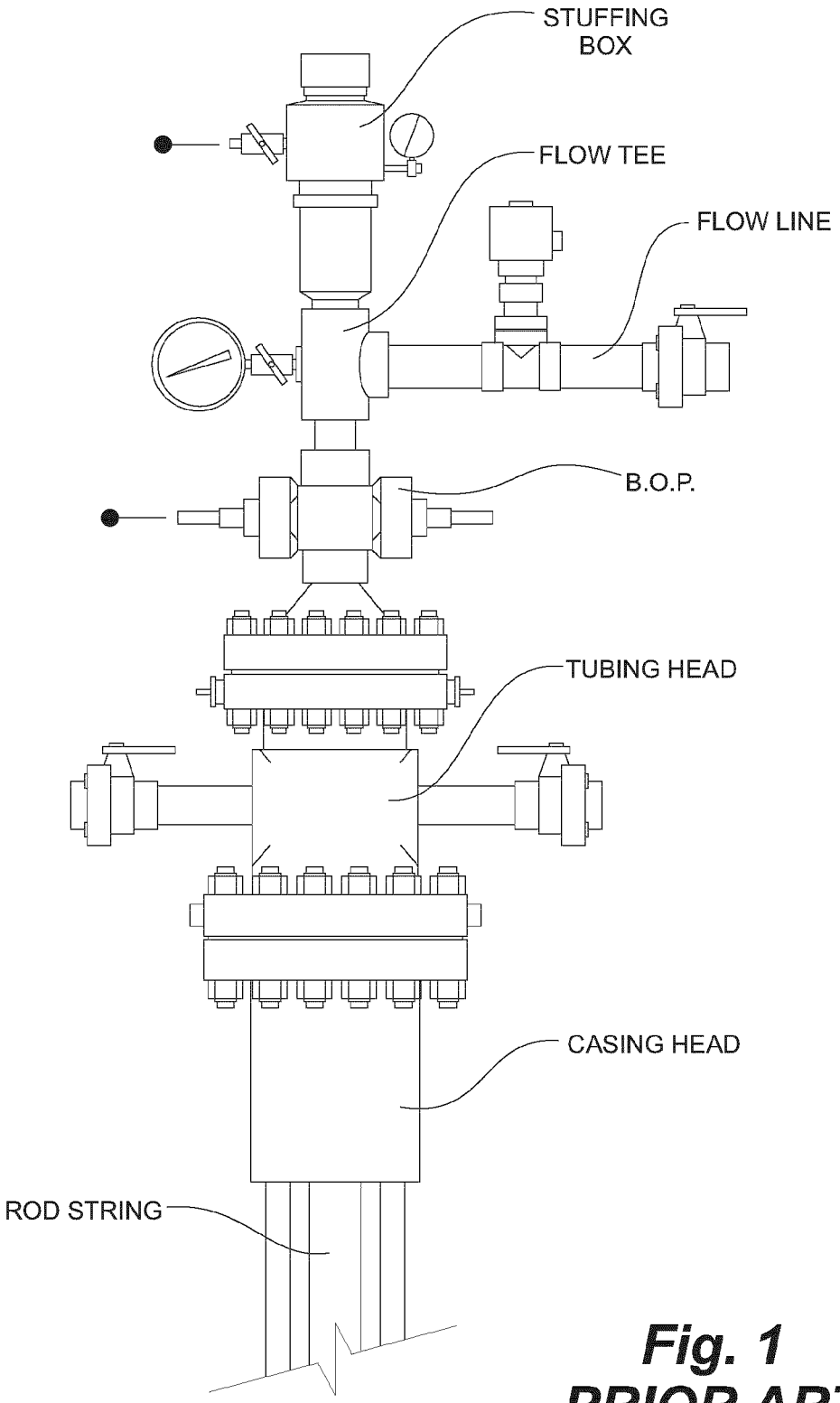
Fig. 1 PRIOR ART
FIG. 1 (PRIOR ART) is a representative front view of a conventional pumping tree on wellhead for a production well.

As introduced above, conventional wellhead "pumping trees" positioned on the wellhead of a production well are a complicated assembly of valves, spools, and pressure fittings used to control the flow of oil or gas from the production well. Having regard to FIG. 1 (PRIOR ART), conventional pumping trees can include (from bottom to top) a flanged casing head attached to the well casing, a flanged tubing head having an internal hanger from which the tubing string is suspended, an adapter flange, at least one production blowout preventer (B.O.P.), the BOP body having top and bottom threaded connections and having side openings for receiving the BOP rams, a flow tee body having threaded top and bottom connections and at least one side opening for connecting with a flow line, a polish rod stuffing box, and an overground drive assembly (e.g. pumpjack) for reciprocating the well's rod string to power a downhole reciprocating downhole pump (not shown).

During fracturing ("fracking") operations, where injection fluids are pumped into a wellbore at injection rates that are intentionally too high for the formation to withstand (thus causing a fracture), downhole overpressures can cause inadvertent fluid communication between neighbouring wellbores, causing damage thereto (e.g. wellbore blowout, rod string ejection, pump packoff, etc). Unfortunately, because conventional pumping tree componentry is ineffective at sealing wellbores experiencing fracturing overpressures, there is an increased risk of wellbore blowout at wellbores adjacent fracturing operations. Thus, there is a need for improved apparatus and methodologies for modifying at least one production wellhead assembly to withstand overpressures caused by fracturing operations.

Herein, temporary preparations may be made to the wellhead structure on a production wellhead. Such preparations involve removably installing at least one enclosure tubular and pickup corresponding adapter on the pumping tree in a manner that advantageously maintains the rod string in tension. The present preparations may serve to mitigate the prior art problems of expensive recovery of the rod string and potential damage to the rod string and pump if set down. As will be described in more detail, according to embodiments herein, the present preparations contain the rod string wholly within the pressure boundary of the wellhead whilst the rod string in maintained in tension.

Figure 2B:
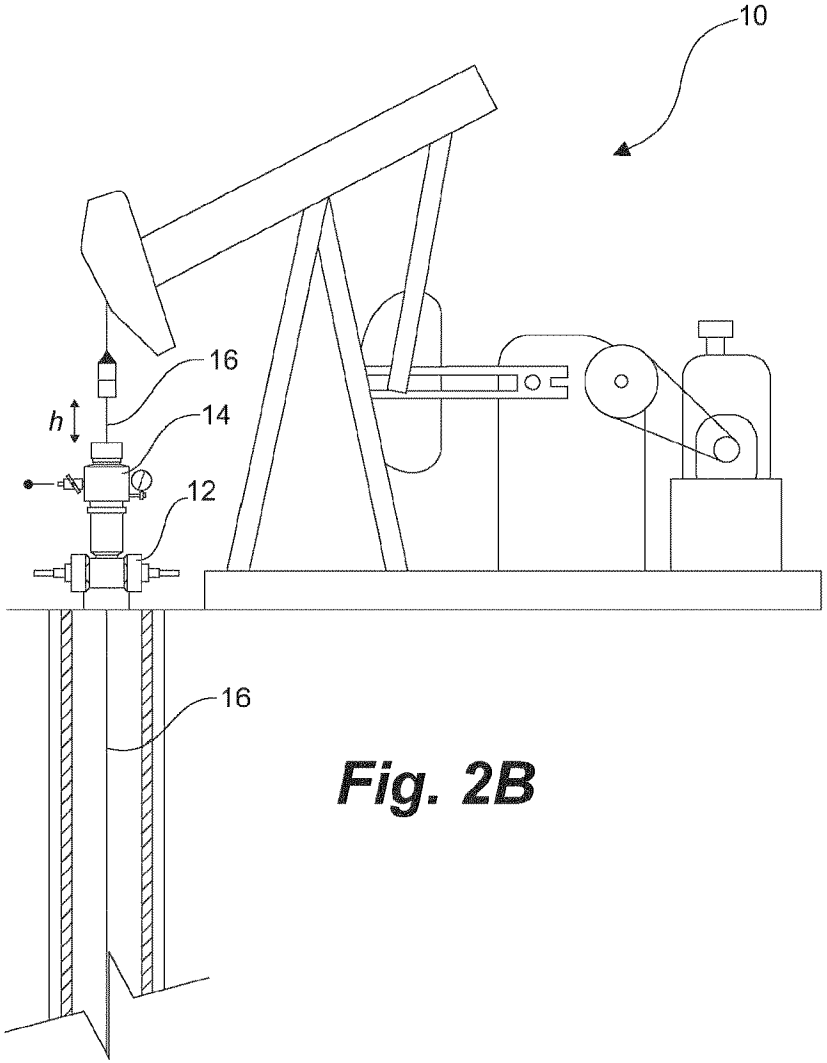
FIGS. 2A and 2B (not to scale) provide a representative cross-sectional view of a pumping tree on the wellhead of a production well according to embodiments herein, the wellhead assembly being transitioned from normal operation (FIG. 2A) to bottom dead centre (FIG. 2B)
Figure 2A:
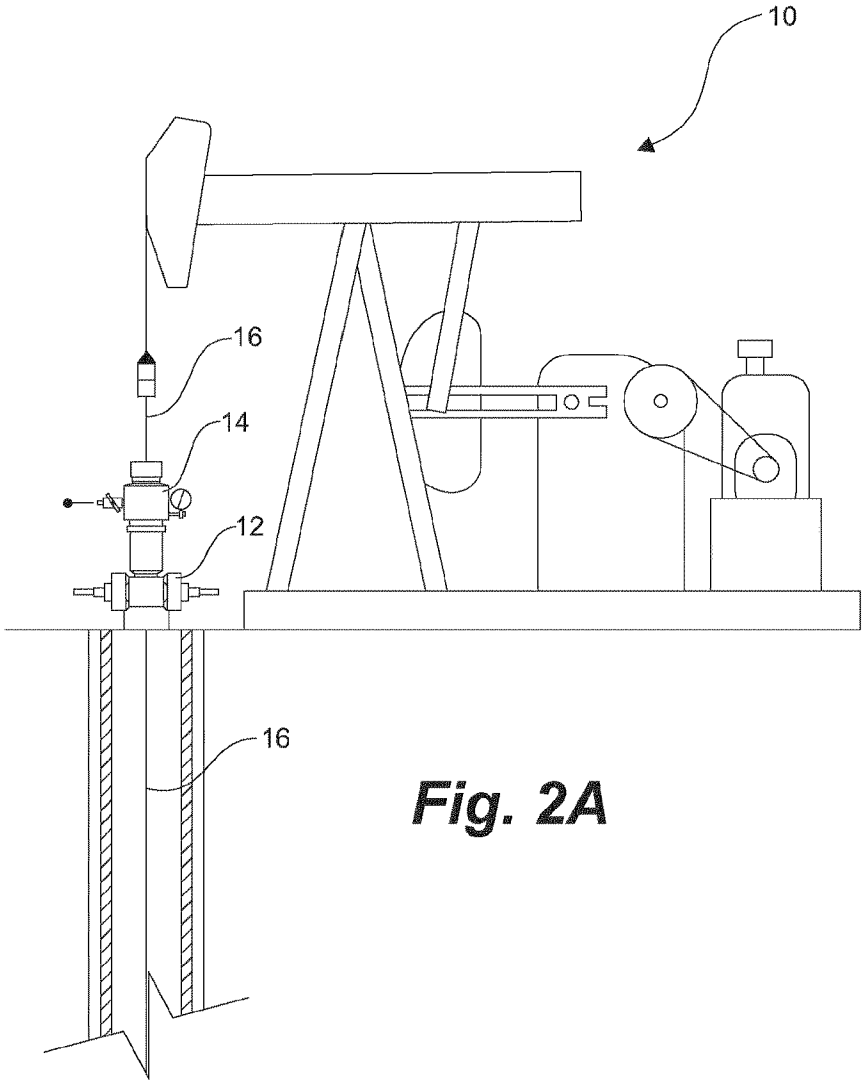
Figure 2D:
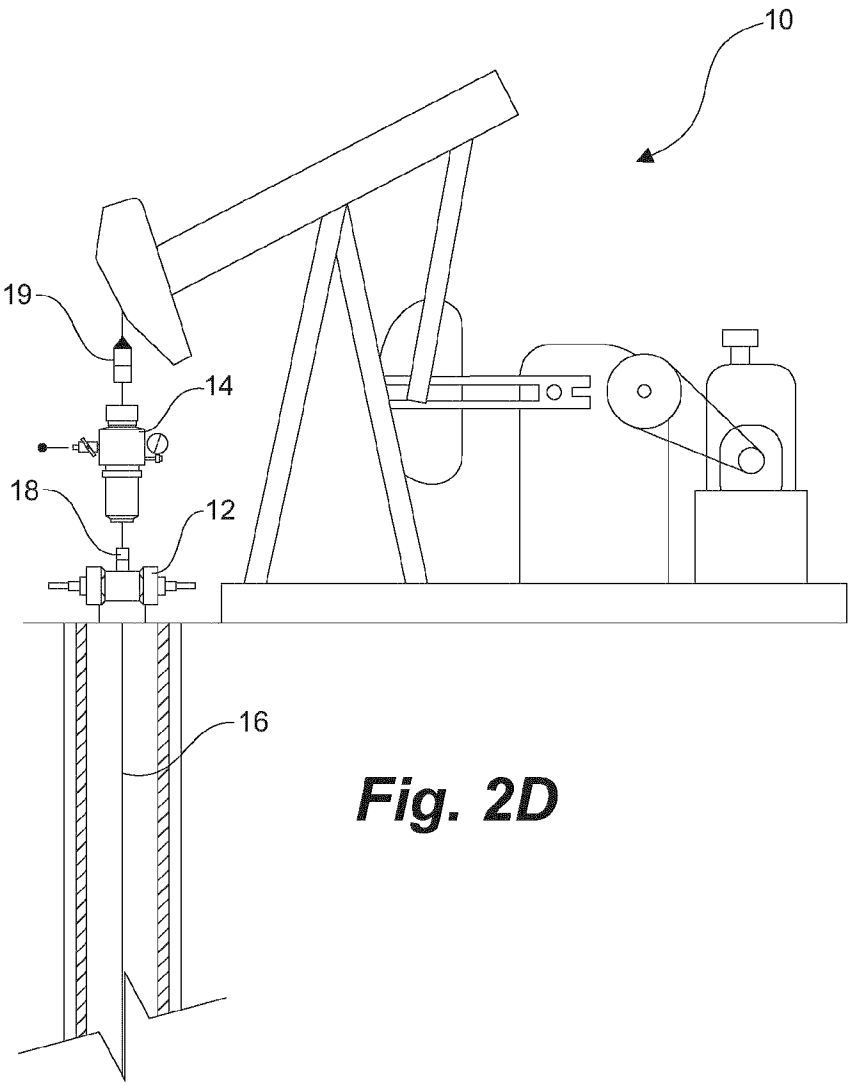
FIGS. 2C, 2D, and 2E provide a representative cross-sectional view of a pumping tree on the wellhead of a production well according to embodiments herein, the stuffing box component of the wellhead structure being removed to allow access to the polish rod.
Figure 2C:
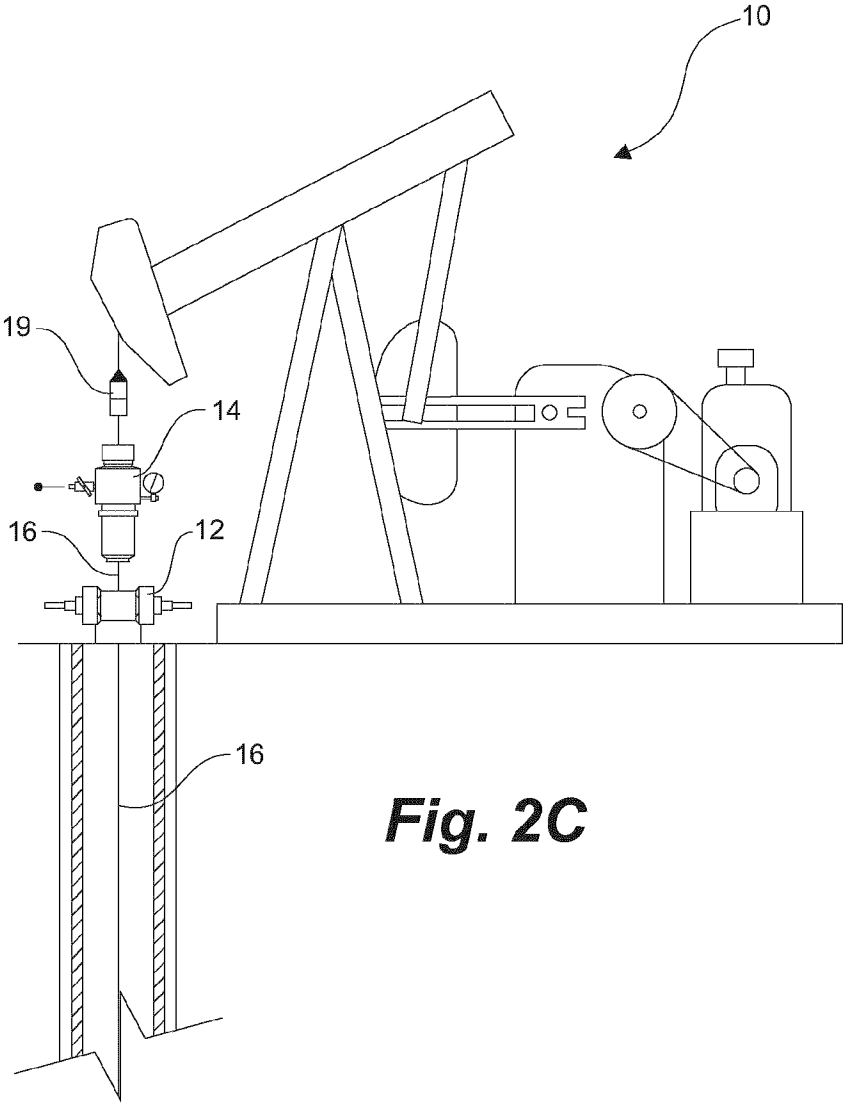
Figure 2E:
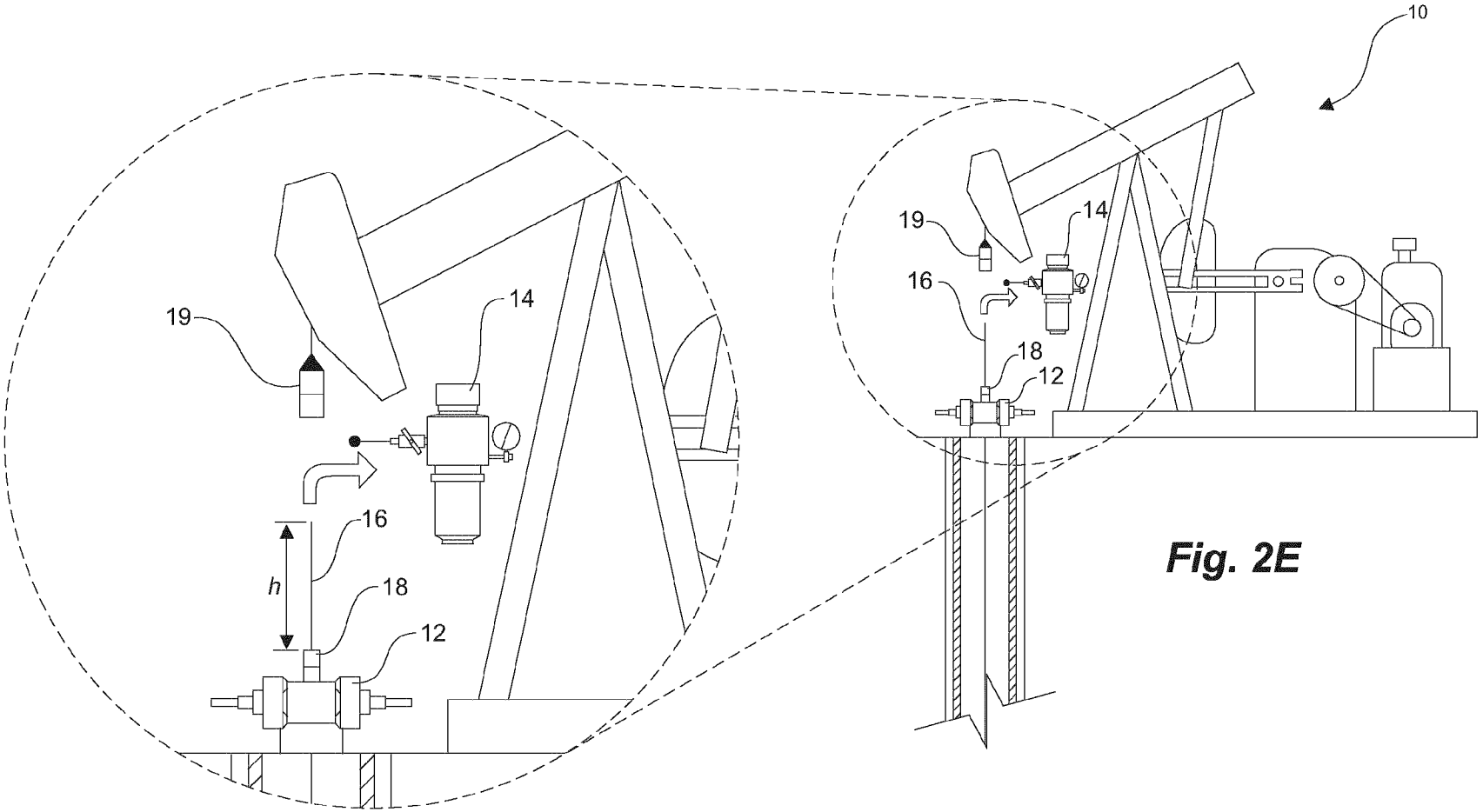
Figures 2F, 2G:
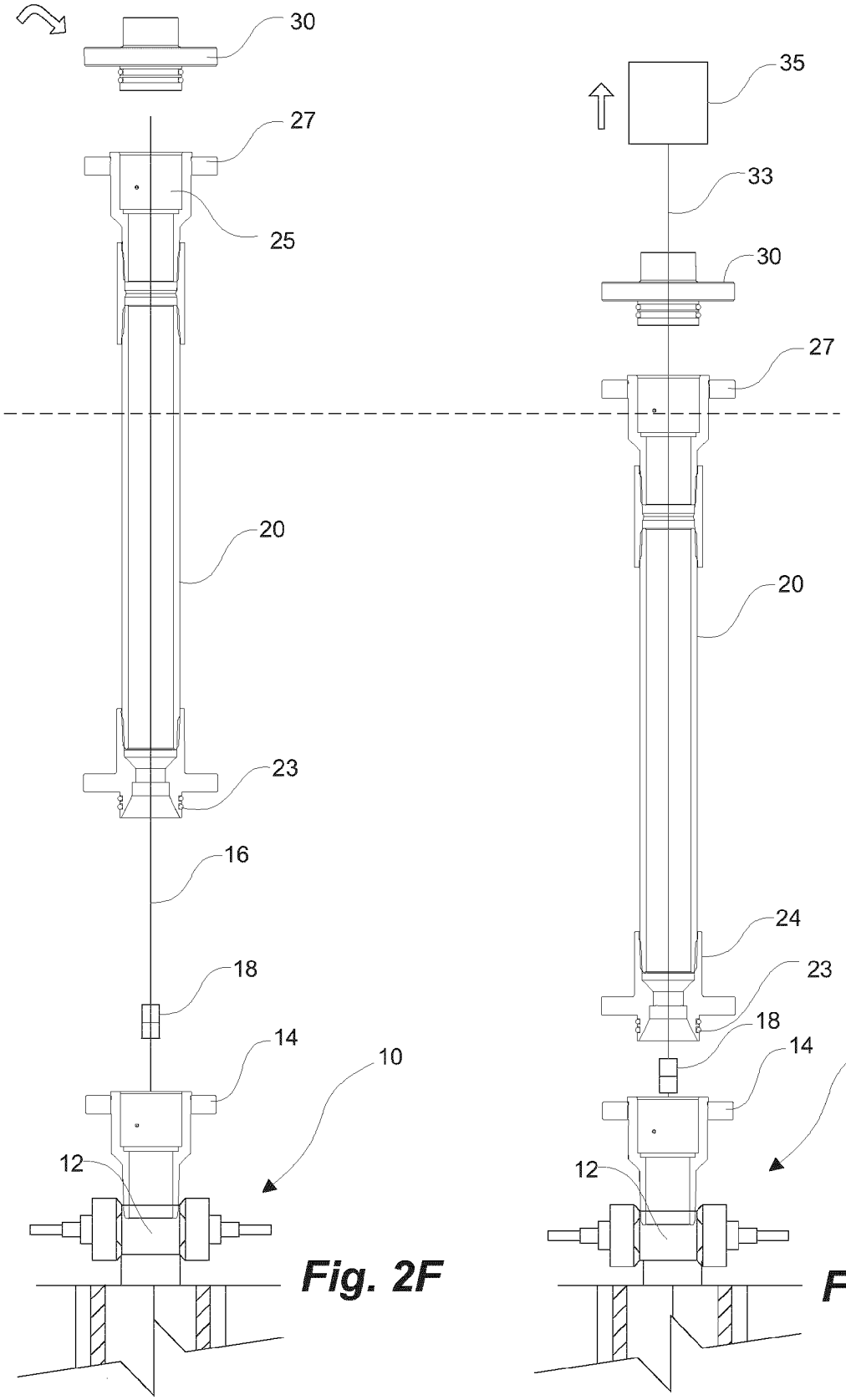
FIGS. 2F and 2G provide a zoomed in representative cross-sectional view of an enclosure tubular being positioned on the wellhead of a production well according to embodiments herein.
Figure 2H:
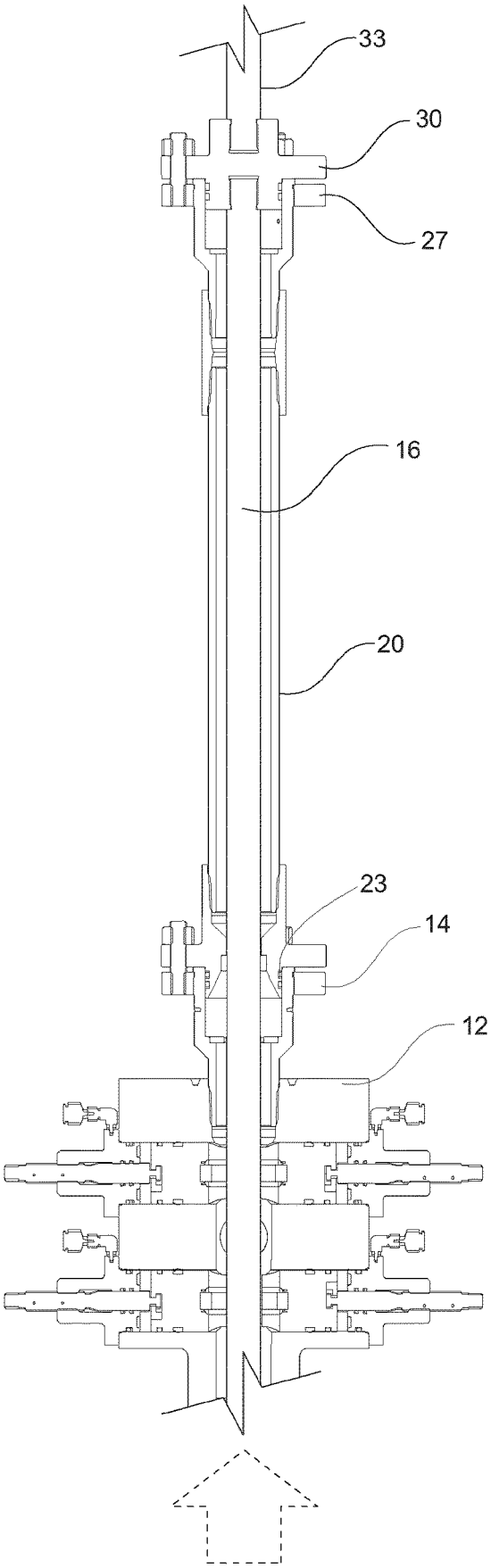
FIG. 2H provides a representative cross-sectional view of the wellhead structure of a production well according to embodiments herein, the wellhead structure being sealed by an enclosure tubular and adapter positioned on the wellhead.

Having regard to FIGS. 2A-2H, a sequence of modifying a wellhead assembly according to embodiments herein is depicted, for explanatory purposes, from normal low-pressure lift scenarios in FIG. 2A, and increasing up to fracturing pressure scenarios that might encroach from a neighbouring wellbore in FIG. 2H. In one aspect, apparatus and methodologies of containing overpressures at a wellhead of a production wellbore are provided. As will be shown, the present modifications may be made to the wellhead structure before the subterranean fracturing operations are initiated, preventing the requirement of shutting in one or more production wells neighbouring the operations. It would be understood that, while such perparations are herein described as being temporary in nature, the present systems be used for more permanent sealing or closing off of wellbores, and whether or not fracturing operations occur.

With specific reference to FIGS. 2A and 2B, the present preparations may be made to a conventional pressure-containing pumping tree assembly on a rod-pumped production wellhead 10. The assembly typically comprises at least one blowout preventer 12 and at least one stuffing box 14 that, along with the remaining componentry (not shown) combine to form a vertical central bore extending through the assembly for receiving the reciprocating polish rod 16 of the rod string. As would be understood, the polish rod 16 is operationally connected to the aboveground drive (e.g. pumpjack) such that the polish rod 16 reciprocates the entire rod string that, in turn, drives the reciprocating downhole pump located downhole (not shown). For simplification purposes, some wellhead componentry may not be shown.

In operation, the present modifications to the production wellhead assembly 10 may commence by initially cycling the assembly 10 to bottom dead centre (e.g. from the position shown in FIG. 2A to 2B), that is—the pumpjack may be positioned in the downstroke pump position, where the pump piston is at the bottom of its stroke (and the traveling valve within the pump is adjacent the standing valve). Positioning the pump at bottom dead centre (FIG. 2B) minimizes pump packoff (i.e. plugging of the wellbore by sand, proppant, or conveyed debris entering the production well as a result of a breakthrough). Once bottom dead centre is achieved, the blowout preventer 12 may be closed, sealingly engaging the rod string extending therethrough.

Having regard to FIGS. 2C-2D, with the blowout preventer 12 sealingly engaging the rod string (i.e. in the closed position), the entire stuffing box 14, or at least an upper portion thereof (e.g. where desirable to leave a lower portion of the box 14 in place; FIGS. 2F,G) may be removed from the wellhead assembly 10 to expose the top end of the rod string and polish rod 16. As above, the stuffing box 14 is generally known to be at least one of the weakest seal containment points of the wellhead assembly 10, and it is therefore desirable to remove at least a portion thereof during the present preparations. Although it may be desirable to effectively replace the weakest seal point of assembly 10, without limitation, it is contemplated that portions of, or all of, the stuffing box 14, the blowout preventer 12, other wellhead assembly 10 componentry, or a combination thereof, may be removed during the present preparations, provided that access to the polish rod 16 of the wellhead assembly be accomplished. In one embodiment, the stuffing box 14 may be removed by sliding same upwardly along the polish rod 16. Herein, rod clamps 18 may be positioned to encompass the polish rod 16, securing the rod string in place on the wellhead assembly 10. As shown in FIG. 2E, the pumpjack bridle 19 can be safely disconnected from polish rod 16 without risk of the rod string dropping, and reducing damage caused by the rod string seating on the downhole pump therebelow. In some embodiments, and to accommodate manipulation of the top end of the polish rod 16 during the present preparations, the polish rod 16 may be raised from the wellbore assembly 10 by a pre-determined working offset, such as, for example, between 1-3 feet.

In embodiments where at least a portion or all of the stuffing box 14 is removed from the wellhead assembly 10, at least a portion of the polish rod 16 may be exposed, extending upwardly from the wellhead assembly 10. For example, in cases where the entire stuffing box 14 is removed, the exposed portion of the polish rod 16 may extend upwardly from the blowout preventer 12 (e.g. FIG. 2E). In cases where only an upper portion of the stuffing box 14 is removed, the exposed portion of the polished rod 16 may extend upwardly from the lower portion of the stuffing box (FIG. 2F,2G). In any case, the length of the exposed polish rod 16 extending upwardly from the wellhead assembly 10 may be measured, such measurement referred to as an enclosure height, h. Enclosure height h may be estimated to be substantially equal to or longer in length than the combined height of the stuffing box 14 and the bridle 19, or substantially equal to or less than the entire piston stroke of the pump (e.g. approximately 3-5 feet in length). As will be described in more detail below, it should be appreciated that the enclosure height h may represent the length of polish rod 16 to be encapsulated in the pressure boundary formed in the presently modified wellhead assembly 10. Advantageously, the present pressure boundary may be formed using at least one enclosure tubular 20 (described in detail below) alone, or in connection with one or more pup tubulars that can be readily manufactured at various lengths to easily accommodate different well sites (e.g. where each well site consists of a different length of polish rod 16 extending above the wellhead assembly 10 at the bottom of the stroke). Thus, with flexibility in the pressure boundary height, an inexpensive apparatus can be configured for the present modifications to any wellhead assembly 10.

Based upon the measured enclosure height h, at least one enclosure tubular 20 having a length substantially equal to or less than the enclosure height h, may be positioned on the wellhead assembly 10. Having regard to FIGS. 2F and 2G, where the upper end of polish rod 16 is extending above the wellhead assembly 10, at least one cylindrical enclosure tubular 20 can be slidingly positioned over the upper end of the exposed polish rod 16. Advantageously, positioning of the enclosure tubular 20 may be enhanced by the working offset of the rod 16 extending from, and remaining accessible through, the upper end of the enclosure tubular 20.

Figure 3:
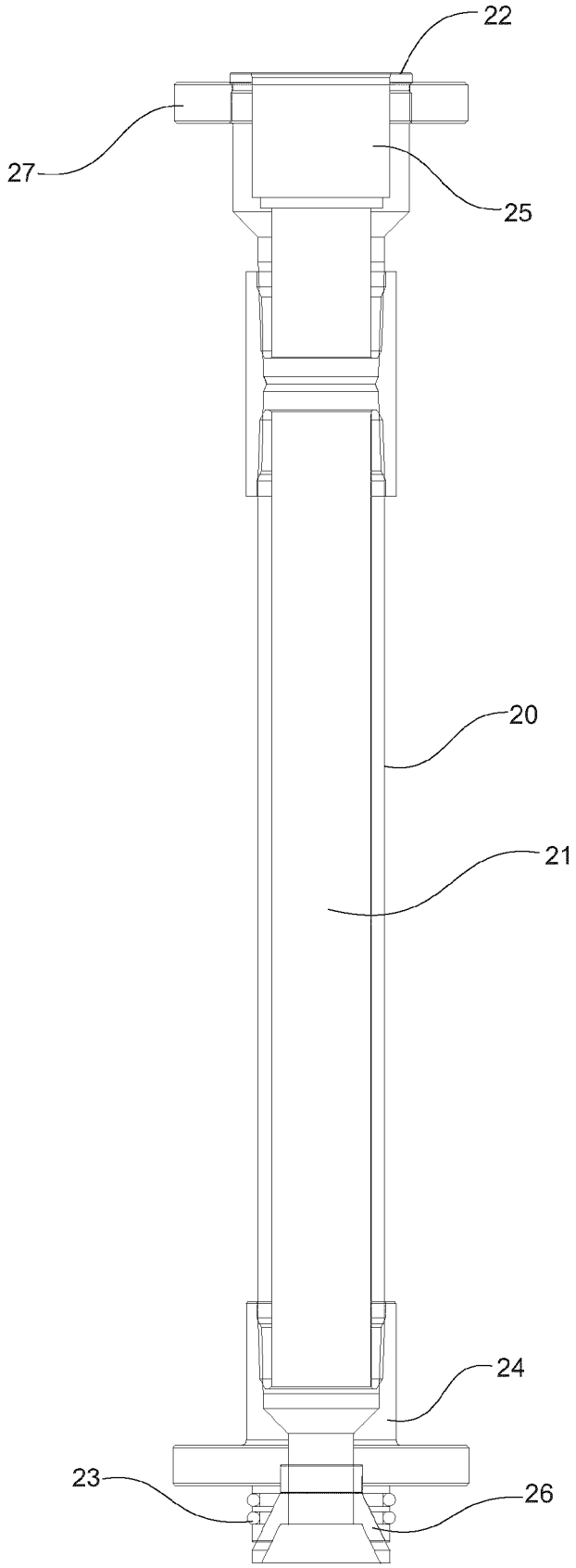
FIG. 3 is a cross-sectional representation of an enclosure tubular according to embodiments herein.

More specifically, having regard to FIG. 3, enclosure tubular 20 may comprise a cylindrical body having upper and lower ends 22,24 configured for sealingly connecting with the wellhead assembly 10. The cylindrical body of enclosure tubular 20 may form a bore 21, configured to receive the polish rod 16 when the tubular 20 is positioned on the wellhead assembly 10. An annular space between the inner surface of the bore 21 and the outer surface of the polish rod 16 form a fluid pathway in communication with the central bore of the wellhead assembly 10. Upper and lower end 22,24 connections may comprise threaded or flanged connections depending upon the interface of the wellhead assembly 10, as would be known in the art. For example, in some embodiments, where desired and depending upon the connection between the enclosure tubular 20 and the componentry of the wellhead assembly 10, enclosure tubular 20 may or may not be configured to form a polish rod seal at a lower end thereof (not shown). In other more preferred embodiments, enclosure tubular 20, having at least one outer annular seal 23 (e.g. O-rings), may be slidingly received within a lower portion of the at least one stuffing box 14, such that no polish rod seal is required. In such cases, enclosure tubular 20 may be bolted to the lower housing the stuffing box 14, enabling quick and simple installation of the enclosure tubular 20.

In some embodiments, upper end 22 of tubular 20 may form a sealing bore 25. As described in more detail below, sealing bore 25 may be configured to sealingly connect with an adapter 30, a pup tubular 33, a spacer, or the like, positioned thereabove to provide the balance of the enclosure height h. In preferred embodiments, upper end 22 may be configured to form a flanged closure 27.

In some embodiments, lower end 24 of tubular 20 may be configured to be slidingly received by the wellhead assembly 10 and, more particularly, within a lower portion of the at least one stuffing box 14. As above, lower end 24 may provide one or more outer annual seal 23 (e.g. O-rings) for sealingly engaging the wellhead assembly 10. In other embodiments, for example where the entire stuffing box 14 may be removed from wellhead assembly 10, lower end 24 may be configured to house at least one conical polish rod seal (not shown) sized to fit within the central bore and about polish rod 16. In such a case, lower end 24 of tubular 20, when sealingly engaged with the wellhead assembly 10, may effectively serve as a seal actuation interface for compressing the seals 26 to better effect a rod seal.

Figure 4:
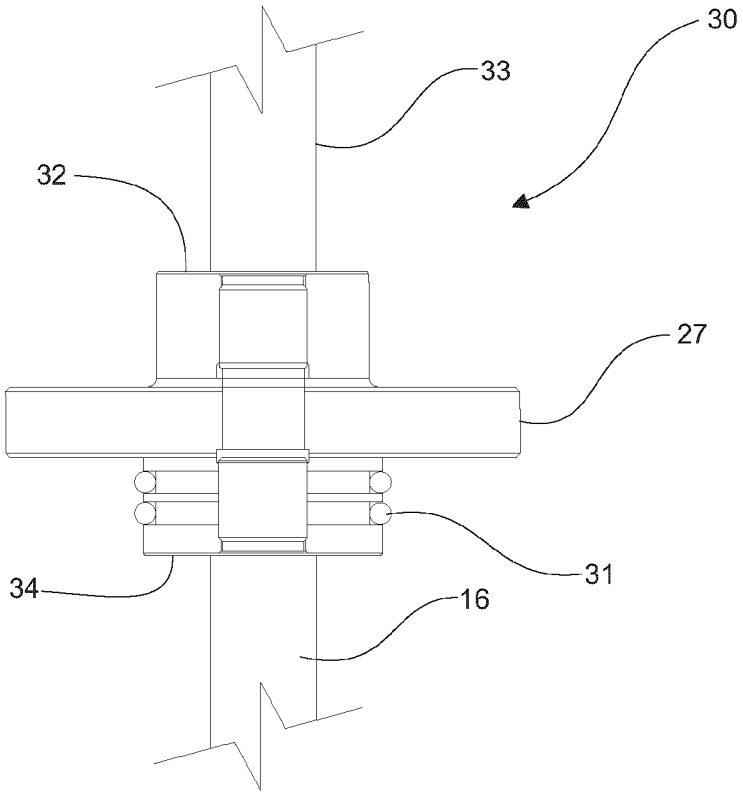
FIG. 4 is a cross-sectional representation of an pickup adapter according to embodiments herein.

Referring again to FIG. 2F, with the enclosure tubular 20 installed over rod string 16, an adapter 30 may be positioned on the wellhead assembly 10 to seal the enclosure tubular 20 and to provide a temporary closure of the entire wellhead assembly 10 (arrow). As shown in more detail in FIG. 4, adapter 30 may comprise a pickup adapter (e.g. blank coupling) having upper and lower ends 32,34. It should be understood that, because adapter 30 serves to seal the wellhead assembly 10, adapter 30 does not provide fluid communication therethrough (i.e. no fluid communication between upper and lower ends 32,34 of the adapter 30). In some embodiments, upper end 32 of adapter 30 may be configured for mechanically connecting with a pony rod 33 and/or an overhead lifting device (e.g. the pump jack, a crane or other movable support), the lifting device operative to maintain the entire rod string in tension. Lower end 34 may be configured to form a cylindrical bore for slidingly installing adapter 30 onto polish rod 16 and within sealing bore 25 of enclosure tubular 20. Upper and/or lower end 32,34 connections may comprise threaded or flanged connections depending upon the wellhead assembly 10, as would be known in the art. As above, and for illustrative purposes, lower end 34 may have flanged closures (and corresponding outer annular seals 31, e.g. O-ring seals) such that, at its lower end 34, adapter 30 may be slidingly mounted onto the wellhead assembly 10 (e.g. the upper end 22 of the enclosure tubular 20) and bolted in place with studs or bolts, or other connections known in the art, enabling quick and simple installation of the adapter 30. Advantageously, the presently configured enclosure tubular 20 and adapter 30 can be used in a manner that creates a pressure envelope above and around the exposed polish rod 16, while avoiding threaded connections (minimizing the risk of threading or unthreading the polish rod 16 and/or rod string).

Upper end 32 of adapter 30 may be configured for temporary coupling to a lifting device 35 for hoisting the polish rod 16 (and the rod string depending therefrom) and holding it in position within the wellhead assembly 10. As such, adapter 30 enables connection between the rod string (i.e. polish rod 16) to the lifting device 35 during the temporary sealing off of the wellhead assembly 10, ensuring that the entire rod string remains in tension. In some embodiments, upper end 32 of adapter 30 may be configured to couple (e.g. threaded connection) with one or more pony rods 33, easing connection for pickup and lowering of the polish rod 16 (and the rod string depending therefrom).

Returning to FIG. 2G, with the weight of the rod string borne by the lifting device 35 (upward arrow), the rod clamps 18 may be removed, unblocking the connection to the wellhead assembly 10 therebelow. Enclosure tubular 20 may be sealingly connected to the wellhead assembly 10 and the adapter 30 sealingly connected to the enclosure tubular 20, forming a complete pressure envelope at the wellhead assembly 10 during fracturing operations. As shown in FIG. 2H, any subsequent overpressure (represented by dotted arrow) would reach the blowout preventer 12, and if flowing thereby, would be arrested and contained at the enclosure tubular 20 and adapter 30. If the rod string is forced upwardly from the wellbore, the force is restrained and conducted to the adapter 30, to the enclosure tubular 20, and back to the wellhead assembly 10.

Where desired, the present preparations can be quickly reversed to return the production well to flow operations. Briefly, and simply in the reverse order of the modifications described above, with the weight of the polish rod 16 borne by the lifting device 35, adapter 30 can be disconnected from the enclosure tubular 20 and the enclosure tubular 20 can be disconnected from the wellhead assembly 10. Once tubular 20 is disconnected, rod clamps 18 may be re-fitted around the polish rod 16 above the wellhead assembly 10, securing the polish rod 16 in place. With the rod string 16 supported by the clamps 18, the lifting device 35 can be disconnected, once again exposing at least a portion of the polish rod 16. Adapter 30 and tubular 20 may be slidingly removed from the rod 16. The stuffing box 14 may be re-installed, or reassembled) over the polish rod 16. The pumpjack bridle 19 can again be installed and secured to the exposed end of the polish rod 16, supporting the rod string. The rod clamps 18 can be removed and the stuffing box 14 operationally connected to the wellhead assembly 10, and the blowout preventer 12 opened for resumption of production flow operations.

Although the present description of embodiments and its advantages have been described in detail, it should be understood that various changes, substitutions, and alternations can be made herein without departing from the scope of the disclosure as defined by the following claims.

We claim:

1. A method of temporarily modifying a production wellhead assembly on a wellbore subjected to increased pressures from subterranean fracturing, the wellhead assembly including at least one blowout preventer and at least one stuffing box, and the wellhead assembly forming a central bore for receiving a rod string operatively connected to a drive mechanism for operating a downhole pump, the method comprising:

positioning the rod string at bottom dead centre, the rod string comprising at least one polish rod, measuring an enclosure height of an exposed portion of the polish rod extending upwardly from the wellhead assembly, positioning at least one enclosure tubular over the exposed portion of the polish rod, the enclosure tubular having an upper end and a lower end and having a length substantially equal to the enclosure height, wherein, when in position, the enclosure tubular sealingly engages with the wellhead assembly; and positioning at least one adapter over the exposed portion of the polish rod, the adapter having an upper end and a lower end, wherein, when in position, the lower end of the adapter sealingly engages with the upper end of the enclosure tubular to receive and contain the increased pressures from the fracturing operations.

2. The method of claim 1, wherein the method comprising initially sealingly engaging the at least one blowout preventer around the rod string.

3. The method of claim 1, wherein the method comprises removing at least a portion of the at least one stuffing box from the wellhead assembly prior to positioning the enclosure tubular over the exposed portion of the polish rod.

4. The method of claim 1, wherein at least one rod clamp may be used to temporarily secure the polish rod in place on the wellhead assembly.

5. The method of claim 1, wherein the measurement of the enclosure height comprises measuring the height of the polish rod 10 extending upwardly from the at least one blowout preventer of the wellhead assembly.

6. The method of claim 1, wherein the lower end of the enclosure tubular is sealingly engaged with a lower portion of the stuffing box of the wellhead assembly.

7. The method of claim 1, wherein the lower end of the enclosure tubular is sealingly engaged with the at least one blowout preventer of the wellhead assembly.

8. The method of claim 1, wherein the method further comprises coupling the adapter, via the upper end of the adapter, to a lifting device for maintaining the rod string in tension.

9. The method of claim 7, wherein the upper end of the adapter may first be coupled to one or more pony rods prior to coupling with the lifting device.

10. The method of claim 1, wherein the method is performed prior to the fracturing operations.

11. The method of claim 1, wherein the subterranean fracturing occurs at one or more wellbore adjacent the production wellhead assembly.

12. The method of claim 1, wherein the method may be performed in reverse in order to return the production wellhead to flow operation.

13. An apparatus for reversibly modifying a production wellhead assembly on a wellbore subjected to increased pressures from subterranean fracturing operations adjacent the wellhead assembly, the wellhead assembly forming a central bore for receiving a rod string operatively connected to a drive mechanism for operating a downhole pump, the apparatus comprising:

at least one enclosure tubular, the tubular comprising a cylindrical body having upper and lower ends, and a tubular bore in fluid communication with the central bore of the wellhead assembly, for receiving the rod string and providing a fluid pathway therearound, the lower end of the enclosure tubular configured to sealingly connect with the wellhead assembly, the upper end of the enclosure tubular configured to provide a sealing bore, and at least one adapter, the adapter comprising upper and lower ends, the lower end configured for sealingly connecting with the sealing bore of the enclosure tubular to receive and contain the increased pressures from the fracturing operations.

14. The apparatus of claim 13, wherein the wellhead assembly comprises at least a blowout preventer.

15. The apparatus of claim 13, wherein the wellhead assembly comprises at least a blowout preventer and at least a portion of a stuffing box.

16. The apparatus of claim 14, wherein the lower end of the enclosure tubular is configured to be slidingly received within the at least one blowout preventer or portion of the stuffing box.

17. The apparatus of claim 16, wherein the lower end of the enclosure tubular comprises a flanged connection for bolting the enclosure tubular in place.

18. The apparatus of claim 13, wherein the lower end of the adapter comprises a flanged connection for bolting the adapter to the upper end of the enclosure tubular.

19. The apparatus of claim 13, wherein the upper end of the adapter may be coupled to a lifting device for supporting the rod string, maintaining the rod string in tension.

20. The apparatus of claim 19, wherein the upper end of the adapter may be coupled to one or more pony rods prior to coupling with the lifting device.

* * * * *